US005718745A

United States Patent [19]

Itoh et al.

[11] Patent Number: 5,718,745

[45] Date of Patent: Feb. 17, 1998

[54] ELECTROLESS PLATING BATH FOR FORMING BLACK COATINGS AND PROCESS FOR FORMING THE COATINGS

[75] Inventors: Hideya Itoh; Shizuo Toyoda; Tadao Senba, all of Tokyo, Japan

[73] Assignee: Japan Kanigen Co., Ltd., Tokyo, Japan

[21] Appl. No.: 693,548

[22] Filed: Aug. 7, 1996

[30] Foreign Application Priority Data

Aug. 9, 1995 [JP] Japan ..... 7-202993

[51] Int. Cl.[6] ..... C23C 18/34

[52] U.S. Cl. ..... 106/1.22; 106/1.27; 427/438; 427/443.1

[58] Field of Search ..... 106/1.22, 1.27; 427/443.1, 438

[56] References Cited

U.S. PATENT DOCUMENTS

| | | | |
|---|---|---|---|
| 3,971,861 | 7/1976 | De Waltoff | 106/1.22 |
| 5,269,838 | 12/1993 | Inoue et al. | 106/1.27 |
| 5,304,403 | 4/1994 | Schlessinger et al. | 427/437 |

*Primary Examiner*—Helene Klemanski

*Attorney, Agent, or Firm*—Burns, Doane, Swecker & Mathis, L.L.P.

[57] ABSTRACT

An electroless plating bath for forming black coatings containing a nickel salt and a reducing agent, which further contains a sulfur-containing compound, zinc ions and optionally microparticles, and a method for forming black coatings by electroless plating, wherein an article to be plated is immersed in the plating bath for a certain period of time, which provide black plated coatings without any post-treatments for blackening. Also provided is an article having an electrolessly plated black coating formed by the method.

23 Claims, No Drawings

ELECTROLESS PLATING BATH FOR FORMING BLACK COATINGS AND PROCESS FOR FORMING THE COATINGS

BACKGROUND OF THE INVENTION

The present invention relates to a plating bath composition for forming black coatings, process for forming black plated coatings and an article having a black plated coating.

Black coatings are currently utilized in the field of optical equipments such as cameras and parts of analytical instruments. Black coatings are also used for surface finishing of solar collectors as selective absorption membranes for sun light. Black coatings are also used for blackening lead flame materials in the photoetching process of IC lead flames. Blackening can improve ultra-violet ray absorption efficiency so that the exposure time can be shortened, and hence stable reproducibility of the products is obtained. They are also utilized for transmission paths for optical communication or decoration purposes.

Conventionally utilized methods for forming black coatings are painting, coloration, chemical conversion treatments (surfaces of zinc, copper, iron etc.), vacuum deposition, sputtering, ion plating and the like. However, black coatings formed with these methods are insufficient in black color tone and film thickness precision, and their thickness is limited. Electrolytic plating methods such as electrolytic coloration of alumite, forming of black nickel or black chrome are utilized, too. However, since these plating methods utilize electric current for performing plating, they cannot afford a uniform thickness on complex shapes or edges or inside of holes due to the fluctuation of current density.

Methods for forming blackened coatings utilizing electroless nickel plating have also been known (Japanese Patent Publication Nos. 57-174442, 59-22786, 64-7153 and 7-42558). In these methods, however, blackening is achieved by immersing plated articles in a solution of chemicals for oxidizing, etching or decoloring the surfaces of electrolessly plated nickel coatings.

Japanese Patent Publication No. 3-17227 also discloses a method for forming blackened coatings utilizing electroless nickel plating. In this method, electrolessly plated nickel coatings are blackened by reverse electrolysis in a solution containing $CrO_3$.

All of those methods for forming black coatings utilizing electroless nickel plating described in the prior art mentioned above achieve blackening of coatings by post-treatments. Therefore, they have drawbacks such as follows.

(1) They suffer from low operability due to the additional process steps.

(2) Thickness of the plated coatings should be at least 5 to 10 μm, because the plated surface may be dissolved in the post-treatments.

Therefore, long time is needed to form the coatings.

(3) Accurate adjustments of time for the immersion in chemicals and concentration of chemicals are needed to avoid exposure or dissolution of the mother materials.

(4) Thickness of the coatings is reduced because of the dissolution of the plated surface, and hence corrosion resistance may be degraded or it is impossible to obtain good size precision.

(5) Ununiform blackening may occur due to ununiform dissolution.

(6) Original plated layer is likely to be exposed due to wearing of the blackened surface, since only the surface has been blackened.

Therefore, one of the objects of the present invention is to provide an electroless plating bath for forming black coatings which can form black plated coatings without any post-treatments for blackening.

Another object of the present invention is to provide a method for forming black coatings utilizing the plating bath mentioned above.

An additional object of the present invention is to provide an article having a black plated coating which formed by the above formation method.

DESCRIPTION OF THE INVENTION

The present invention relates to an electroless plating bath for forming black coatings containing a nickel salt and a reducing agent, which further contains a sulfur-containing compound and zinc ions.

The present invention also relates to a method for forming black coatings by electroless plating, wherein an article to be plated is immersed in the plating bath of the present invention mentioned above for a certain period of time.

The present invention further relates to an article having an electrolessly plated black coating formed by the above method for forming black coatings by electroless plating.

The present invention will be further explained hereinafter.

Electroless plating baths which contain a nickel salt and a reducing agent (e.g., Ni-P, Ni-B) have conventionally been known. However, black plated coatings could not be yielded in the conventional nickel electroless plating baths. The plating bath of the present invention additionally contains at least a sulfur-containing compound and zinc ions in a conventional nickel electroless plating bath.

Examples of the nickel salt contained in the plating bath of the present invention are nickel sulfate, nickel chloride, nickel carbonate, nickel acetate, ammonium nickel sulfate, nickel citrate, nickel hypophosphite and the like. These compounds may be used alone or in any combination thereof.

Concentration of the nickel salt is suitably in the range of 1 to 50 g/liter since such a concentration yields normal plating of coatings and stability of the plating bath. The concentration of the nickel salt is preferably in the range of 5 to 30 g/liter. When the concentration of the nickel salt is too low, plating defects such as unplated portions may be observed. On the other hand, when the concentration of the nickel salt is too high, the plating bath may become instable so that decomposition may occur or it may become likely to adhere to bath tanks.

Examples of the reducing agent contained in the plating bath of the present invention are, for example, sodium hypophosphite, potassium hypophosphite, sodium borohydride, potassium borohydride, alkylaminoborons such as dimethylaminoborane and diethylaminoborane and hydrazine. These compounds may be used alone or in any combination thereof.

Concentration of the reducing agent is suitably in the range of 0.1 to 100 g/liter in terms of normal formation of the plated coatings and stability of the plating bath. The concentration of the reducing agent is preferably in the range of 10 to 40 g/liter. When the concentration of the reducing agent is too low, nickel coatings may not form. On the other hand, when the concentration of the reducing agent is too high, plating bath becomes instable and may become likely to be decomposed or adhere to bath tanks, or blackening tends to become impossible because the reaction is accelerated.

The sulfur-containing compound contained in the plating bath of the present invention is, for example, a compound bearing one or more sulfur-containing groups selected from —SH (mercapto group), —S— (thioether group), >C=S (thioaldehyde group, thioketone group), —COSH (thiocarboxyl group), —CSSH (dithiocarboxyl group), —$CSNH_2$ (thioamide group) and —SCN (thiocyanate group, isothiocyanate group). The sulfur-containing compound may be either an organic sulfur compound or an inorganic sulfur compound.

Examples of the sulfur-containing compound are, for example, thioglycolic acid, thiodiglycolic acid, cysteine, saccharin, thiamine nitrate, sodium N,N-diethyldithiocarbamate, 1,3-diethyl-2-thiourea, dipyridine, N-thiazole-2-sulfamylamide, 1,2,3-benzotriazole 2-thiazoline-2-thiol, thiazole, thiourea, thiozole, sodium thioindoxylate, o-sulfonamide benzoic acid, sulfanilic acid, Orange-2, Methyl Orange, naphthionic acid, naphthalene-α-sulfonic acid, 2-mercaptobenzothiazole, 1-naphthol-4-sulfonic acid, Scheffer acid, sulfadiazine, ammonium rhodanide, potassium rhodanide, sodium rhodanide, rhodanine, ammonium sulfide, sodium sulfide, ammonium sulfate etc.

Concentration of the sulfur-containing compound is suitably in the range of $10^{-4}$ to 10 g/liter, because the concentration in such a range yields good black color tint. More preferably, it is in the range of $10^{-3}$ to 1 g/liter. When the concentration of the sulfur-containing compound is too low, blackening may become impossible, or gray tone may be obtained. On the other hand, when the concentration of sulfur-containing compound is too high, plating reaction may stop and hence plated coatings may not form.

Zinc ions contained in the plating bath of the present invention can be incorporated into the plating bath by introducing a zinc compound into the bath. Examples of the zinc compound are zinc carbonate, zinc oxide, zinc chloride, zinc benzoate, zinc nitrate, zinc phosphate, zinc stearate, zinc salicylate, zinc sulfate, zinc sulfide etc.

Concentration of zinc ions is suitably in the range of $10^{-3}$ to 30 g/liter, because the concentration in such a range yields black plated coatings with good tint and stability of the plating bath. The concentration is more preferably in the range of of 0.1 to 10 g/liter. When the concentration of zinc ions is too low, blackening may not be completed. On the other hand, too high concentration of zinc ions tends to yield browny tone and instability of the plating bath, which may cause adhesion to plating bath tanks.

It is desirable that the plating bath of the present invention contains a nitrogen-containing compound in addition to the above components. The nitrogenous compound may be a compound having one or more nitrogen-containing groups selected from —$NH_2$ (primary amino group), >NH (secondary amino group), ≡N (tertiary amino group), ≡N— (quarternary ammonium group), —N=N—(azo group, heterocyclic group), >C=N— (Schiff base residue, heterocyclic group), C=N—OH (oxime group), >C=NH (imine group, enamine group) etc. Examples of the nitrogenous compounds are ammonia, hydrazine, triethanolamine, glycine, alanine, aspartic acid, ethylenediamine, triethylenetetramine, pyridine and the like.

Concentration of the nitrogenous compound is suitably in the range of $10^{-4}$ to 50 g/liter, since such a concentration enables to form good plated black coatings. The concentration of the nitrogenous compound is preferably in the range of 0.1 to 10 g/liter. When the concentration of the nitrogenous compound is too low, it may be impossible to form black coatings, or black color may become light and thus it may difficult to obtain good black color. On the other hand, when the concentration of the nitrogenous compound is too high, black plated coatings tend to become fragile.

The plating bath of the present invention may contain, in addition to the above components, additives with various kinds of purposes so long as the properties of the plating bath are not deteriorated.

For example, metal ion complexing agents, pH buffers, accelerants including organic acids such as formic acid, acetic acid, propionic acid, oxalic acid, succinic acid, malonic acid, maleic acid, itaconic acid, glycolic acid, lactic acid, salicylic acid, tartaric acid, citric acid, malic acid, glycine, salts thereof and the like can be added to the bath.

Concentrations of the metal ion complexing agents, pH buffers and accelerants may be, for example, in the range of 1 to 200 g/liter.

As a stabilizer, one or more kinds of ions selected from lead, bismuth, antimony, tellurium, copper ions and the like can be further added to the bath. These ions may be incorporated into the bath by adding, for example, lead nitrate, lead acetate, lead sulfate, lead chloride, bismuth acetate, bismuth nitrate, bismuth sulfate, antimony chloride, potassium antimonyl tartrate, telluric acid, tellurium chloride, tellurium dioxide, cuprous sulfate, cuprous chloride, cuprous carbonate, cuprous oxalate and the like.

Concentration of the stabilizer is suitably in the range of, for example, $10^{-4}$ to 1 g/liter.

pH of the plating bath of the present invention may suitably be in the range of 4 to 14, preferably in the range of 6 to 12. When the pH becomes lower than 5.5, black color gradually becomes light and the color changes from gray to nickel color. On the other hand, the pH becomes higher than 12, adjustment for obtaining block color becomes more and more difficult. When the pH of the bath is too high, it can be adjusted by adding, for example, sulfuric acid. When the pH of the bath is too low, it can be adjusted by adding, for example, aqueous ammonia or sodium hydroxide.

The plating bath of the present invention may further contain microparticles dispersed therein. By using the plating bath containing dispersed microparticles, composite electrolessly plated black coatings containing these microparticles can be obtained.

The microparticles preferably have a particle size in the range of 0.01 to 10 μm, because microparticles having a particle size in such a range can show good dispersibility and good incorporation into the coatings and yield good color tone. The particle range is preferably in the range of 0.1 to 5 μm. When the particle size is too small, they cannot sufficiently disperse in the bath, and may aggregate or may be likely to float, and thus they become difficult to be contained in the coatings as eutectoid. When the particle size is too large, they may precipitate in the bath and thus they are difficult to be incorporated in the coatings, or good black color tone may not be obtained due to the color of the microparticles.

Content of the microparticles in the bath is suitably in the range of 0.1 to 20 g/liter, because a content of the microparticles in such a range may show good incorporation into the coatings and yield good color tone. The content of the microparticles is preferably in the range of 0.5 to 10 g/liter. When the content is too low, they are difficult to be contained in the coatings as eutectoid, and properties inherently characteristic of the microparticles may not be obtained. When the content is too high, the stabilizer is unduly consumed and the bath would become instable and the coating surfaces may become coarse, or the color tone of the black coating matrices may be adversely affected, or the coatings may become brittle.

As the microparticles, there can be mentioned those of oxides, carbides, nitrides, borides, silicides, sulfides, synthetic resins, graphite, diamond, mica and the like. These may be used alone or in any combination thereof. Specific examples are exemplified below.

Oxides: $Al_2O_3$, $TiO_2$, $ZrO_2$, $ThO_2$, $CeO_2$, MgO, CaO etc.
Carbides: SiC, WC, TiC, ZrC, $B_4C$, $CrC_2$ etc.
Nitrides: BN, $Si_3N_4$, AlN etc.
Borides: $CrB_2$, $ZrB_2$, TiB, $VB_2$ etc.
Silicides: $CrSi_2$, $MoSi_2$, $WSi_2$ etc.
Sulfides: $MoS_2$, $WS_2$, NiS etc.
Sulfates: $BaSO_4$, $SrSO_4$ etc.
Synthetic resins: PTFEs, (CF)n, phenol resins, epoxy resins, polyamides, organic pigments, microcapsules etc.
Others: graphite, diamond, silica fibers, kaolin, mica, glasses etc.

The formation of the black plated coating of the present invention is accomplished by immersing an article to be plated into the electroless plating bath of the present invention described above for a certain period of time.

Articles which can be plated by the method of the invention are those which can be plated by a conventional electroless nickel plating, and shapes and materials of such articles are not limited. Articles to be plated may be, for example, either metal articles or non-electroconductive articles. Articles which can be treated are, for example, articles of iron, copper, aluminium, alloys thereof, and non-electroconductive articles such as those of stainless plastics, glasses, ceramics may also be plated with the black coatings by making their surfaces catalytic.

Immersion time in the plating bath and bath temperature may be suitably selected by considering composition of the bath, thickness of the coating to be plated. For example, the temperature may be from 60° to 95° C. Although the plating reaction may be performed at a lower temperature by adjusting the bath composition, reaction rate of the plating relation is extremely retarded and adhesion of the coatings is deteriorated in such a case. When the bath temperature is more than 95° C., the plating bath may become instable and the color tone may be deteriorated. Deposited black coatings can be uniformly applied on complex shapes, inside of pipes, edges and the like with a thickness precisely meeting to the desired thickness.

Further, by using a plating bath containing the microparticles, it is also possible to obtain an electrolessly plated uniform black coating containing the microparticles as complexed eutectoid with various properties. By selecting properties of the microparticles, coatings with various degrees of hardness, wear-resistance, lubricity, water-repellency and the like can be obtained.

It is suitable that articles to be plated are subjected to degreasing and activation processes prior to the immersion into the electroless plating bath for forming black coatings. When the plating reaction begins, reaction gas is generated from the material surface and black coatings deposits, and the coatings get thicker with time. Thus, thickness of the coating may be controlled by selecting the immersion time.

Specific Procedures of Conditioning Prior to the Plating

Desirably, articles to be plated are subjected to the following conditioning treatments depending on the kind of materials prior to immersing into the electroless plating bath for forming black coatings.

Irons and steels: (1) alkali degreasing immersion for 5 minutes (50° C.), (2) washing with water, (3) pickling for 2 minutes (18% hydrochloric acid) at ambient temperature, (4) washing with water, and (5) plating.

Coppers: (1) alkali degreasing for 5 minutes (50° C.), (2) washing with water, (3) pickling for 2 minutes (25% hydrochloric acid) at ambient temperature, (4) washing with water, and (5) plating. When materials are immersed into the plating bath, their plating reaction is started by contacting the materials with an iron or aluminum material or an article of which plating reaction has already been started.

Aluminiums: (1) mild alkali degreasing for 5 minutes (40° C.), (2) washing with water, (3) pickling for 15 to 60 seconds (mixture of 67.5% nitric acid, 50% hydrofluoric acid and water [9:2:1]) at 20° to 25° C., (4) washing with water, (5) substitution with zinc for 15 to 30 seconds (sodium hydroxide, zinc oxide etc.) at 25° C., (6) washing with water, (7) pickling for 5 to 10 seconds (5% nitric acid) at ambient temperature, (8) washing with water, (9) substitution with zinc in the same manner as in (5), (10) washing with water, and (11) plating.

Plastics: (1) treatment for making surfaces hydrophilic (20 g/liter of sodium hydroxide, 20 ml of IPA) for 5 minutes at 40° to 60° C., (2) surface roughening (200 to 400 g/liter of anhydrous chromic acid, 250 to 550 g/liter of concentrated sulfuric acid) for 5 minutes at 60° to 70° C., (3) washing with water, (4) acid immersion (50 ml/liter of concentrated hydrochloric acid) for 1 to 2 minutes at ambient temperature, (5) washing with water, (6) sensitizing (10 g of stannous chloride, 50 ml/liter of hydrochloric acid, remainder of water) for 3 minutes at 20° to 30° C., (7) washing with water, (8) activating (1 g/liter of palladium chloride, 10 ml of hydrochloric acid, remainder of water) for 3 minutes at 20° to 30° C.), (9) washing with water, and (10) plating.

Ceramics and glasses: (1) mild alkali degreasing, (2) washing with water, (3) etching (200 ml/liter of 67.5% nitric acid, 100 ml/liter of 50% hydrofluoric acid, remainder of water) for 5 to 10 minutes at ambient temperature, (4) sensitizing (stannous chloride, 50 ml/liter of hydrochloric acid, remainder of water) for 3 minutes at 20° to 30° C., (7) washing with water, (8) activating (1 g/liter of palladium chloride, 10 ml of hydrochloric acid, remainder of water) for 3 minutes at 20° to 30° C., (9) washing with water, and (10) plating.

EXAMPLES

The electroless plating bath composition for forming black coatings and the method for forming the coatings will be further explained by reference to the following examples.

Example 1

After subjecting a test piece (5×5×2t) of soft steel (spcc) to the conditioning treatments mentioned above for irons and steels, it was immersed into a plating bath of which composition is described below. Upon the throwing in, the test piece started to generate gas from its surface and become lightly black and a deeply black coating was formed with lapse of time. After 30 minutes, the test piece was removed from the bath, washed with water and dried, and the thickness of the plated coating was measured. The thickness was about 7.5 μm, and the plated surface was composed of black coating and exhibited uniform color tone.

| | |
|---|---|
| Nickel sulfate | $1 \times 10^{-1}$ mol/l |
| Sodium hypophosphite | $2 \times 10^{-1}$ mol/l |
| Malic acid | $3 \times 10^{-1}$ mol/l |
| Succinic acid | $8 \times 10^{-2}$ mol/l |
| Glycine | $8 \times 10^{-2}$ mol/l |
| Tartaric acid | $3 \times 10^{-2}$ mol/l |
| Ammonium acetate | $5 \times 10^{-2}$ mol/l |
| Zinc sulfate | $5 \times 10^{-3}$ mol/l |
| Sodium N,N-diethyl-dithiocarbamate | $4 \times 10^{-5}$ mol/l |
| Stabilizer (lead acetate) | $8 \times 10^{-6}$ mol/l |
| pH | 8.5 (sodium hydroxide) |
| Plating bath temperature | 90° C. |

For a comparison, plating of a similar test piece was performed with the same plating bath as the above Example 1 except that it lacked the zinc ion source, zinc sulfate, the nitrogenous compound, glycine, and the sulfur compound, sodium N,N-diethyl-dithiocarbamate, while pH was adjusted to 5, which is a usual pH for the conventional electroless nickel plating. Upon the throwing in, the test piece started to generate gas from its surface and plated coating started to deposit. The test piece removed from the bath 30 minutes later did not get black color at all on its surface and the surface was composed of a coating exhibiting whity lustrous nickel color.

Example 2

After subjecting a test piece (5×5×2t) of soft steel (spcc) to the conditioning treatments mentioned above for irons and steels, it was immersed into a plating bath of which composition is described below. Upon the throwing in, the test piece started to generate gas from its surface and become lightly black and a deeply black coating was formed with lapse of time. After 30 minutes, the test piece was removed from the bath, washed with water and dried, and the thickness of the plated coating was measured. The thickness was about 7.0 μm, and plated surface was composed of black coating and exhibited uniform color tone.

| | |
|---|---|
| Nickel sulfate | $7.8 \times 10^{-2}$ mol/l |
| Ammonium nickel sulfate | $1.3 \times 10^{-2}$ mol/l |
| Sodium hypophosphite | $2 \times 10^{-1}$ mol/l |
| Zinc sulfate | $5 \times 10^{-3}$ mol/l |
| Malic acid | $1 \times 10^{-1}$ mol/l |
| Citric acid | $3.5 \times 10^{-2}$ mol/l |
| 1,3-Diethyl-2-thiourea | $8.5 \times 10^{-5}$ mol/l |
| Stabilizer (lead acetate) | $8 \times 10^{-6}$ mol/l |
| pH (aqueous ammonia, sodium hydroxide) | 9.0 |
| Plating bath temperature | 90° C. |

For a comparison, plating of a similar test piece was performed with the same plating bath as the above Example 2 except that it lacked the zinc ion source, zinc sulfate, the nitrogenous compounds, ammonium nickel sulfate and aqueous ammonia, and the sulfur compound, 1,3-diethyl-2-thiourea, while pH was adjusted to 5, which is a usual pH for the conventional electroless nickel plating. Upon the throwing in, the test piece started to generate gas from its surface and plated coating started to deposit. The test piece removed from the bath 30 minutes later did not get black color at all on its surface and the surface was composed of a coating exhibiting whity lustrous nickel color.

Example 3

After subjecting a test piece (5×5×2t) of soft steel (spcc) to the conditioning treatments mentioned above for irons and steels, it was immersed into a plating bath of which composition is described below. Upon the throwing in, the test piece started to generate gas from its surface and become lightly black and a deeply black coating was formed with lapse of time. After 30 minutes, the test piece was removed from the bath, washed with water and dried, and the thickness of the plated coating was measured. The thickness was about 4.0 μm, and plated surface was composed of black coating and exhibited uniform color tone.

| | |
|---|---|
| Nickel sulfate | $1.15 \times 10^{-1}$ mol/l |
| Zinc sulfate | $7 \times 10^{-3}$ mol/l |
| Sodium citrate | $1 \times 10^{-1}$ mol/l |
| Sodium acetate | $1 \times 10^{-1}$ mol/l |
| Glycine | $8 \times 10^{-2}$ mol/l |
| Dimethylaminoborane | $5 \times 10^{-2}$ mol/l |
| Sodium N,N-diethyl-dithiocarbamate | $4 \times 10^{-5}$ mol/l |
| Stabilizer (thalium acetate) | $5 \times 10^{-4}$ mol/l |
| pH (aqueous ammonia) | 7.0 |
| Plating bath temperature | 75° C. |

For a comparison, plating of a similar test piece was performed with the same plating bath as the above Example 3 except that it lacked the zinc ion source, zinc sulfate, the nitrogenous compounds, glycine and aqueous ammonia, and the sulfur compound, sodium N,N-diethyl-dithiocarbamate. Upon the throwing in, the test piece started to generate gas from its surface and plated coating started to deposit. The test piece removed from the bath 30 minutes later did not get black color at all on its surface and the surface was composed of a coating exhibiting whity lustrous nickel color.

Example 4

After subjecting a test piece (5×5×2t) of soft steel (spcc) to the conditioning treatments mentioned above for irons and steels, it was immersed into a plating bath of which composition is described below. Upon the throwing in, the test piece started to generate gas from its surface and become lightly black and a deeply black coating was formed with lapse of time. After 30 minutes, the test piece was removed from the bath, washed with water and dried, and the thickness of the plated coating was measured. The thickness was about 8 μm, and plated surface was composed of black coating and exhibited uniform color tone.

| | |
|---|---|
| Nickel sulfate | $1 \times 10^{-1}$ mol/l |
| Sodium hypophosphite | $2 \times 10^{-1}$ mol/l |
| Malic acid | $3 \times 10^{-1}$ mol/l |
| Citric acid | $3 \times 10^{-2}$ mol/l |
| Zinc sulfate | $5 \times 10^{-2}$ mol/l |
| Sodium N,N-diethyl-dithiocarbamate | $4 \times 10^{-5}$ mol/l |
| Stabilizer (lead acetate) | $8 \times 10^{-6}$ mol/l |
| pH | 10.5 (sodium hydroxide) |
| Plating bath temperature | 90° C. |

Example 5 (Method for Electroless Plating of Black Composite Coatings)

SiC fine powder having an average particle size of 0.5 μm was added to the plating bath of Example 1 in an amount of 2 g/liter and the bath was sufficiently stirred so that the powder was uniformly dispersed therein. Then, a test piece previously subjected to the same conditioning treatment as above was immersed into the bath. After 30 minutes, a black composite SiC coating was formed on the test piece removed from the plating bath. About 5 wt % of SiC was contained in the coating. This black composite plated coating shows wear resistance.

Example 6 (Method for Electroless Plating of Black Composite Coatings)

A dispersion of PTFE (polytetrafluoroethylene) (KANIFLON-④ A-type, trade name of Nippon Kanizen Co., Ltd) was added to the plating bath of Example 1 in an amount of 40 ml/liter and stirred sufficiently. Then, a test piece previously subjected to the same conditioning treatment as above was immersed into the bath. After 30 minutes, a black composite PTFE coating was formed on the test piece removed from the plating bath. About 25 wt % of PTFE was contained in the coating. This black composite plated coating shows lubricity and water repellency.

The black coatings formed in the examples by electroless plating showed good results, i.e., no changes in cross stripe shape adhesion test using an adhesive tape and anti-vibration test (leaving for 14 days in 90% humidity at 35° C.). In the reflection factor test, all of them showed a sufficient absorption characteristic of more than 5 to 10% around a wavelength of 0.9 μm.

Electrolessly plated black coatings can also be formed by using the components for the plating bath described in the appended claims, other than those used in the above examples.

According to the present invention, there can be provided an electroless plating bath for forming black coatings which can form black plated coatings without any post-treatments for blackening.

Further, according to the present invention, there can be provided a method for forming good black coatings utilizing the plating bath of the present invention mentioned above.

Furthermore, according to the present invention, there can be provided an article having a black plated coating with good color tone and a desired thickness, which formed by the above formation method of the present invention.

What is claimed is:

1. An electroless plating bath for forming black coatings containing a nickel salt and a reducing agent, which further contains a sulfur-containing compound and zinc ions wherein the concentration of zinc ions ranges from 0.1–10 g/liter.

2. The electroless bath of claim 1, which contains a nitrogen-containing compound.

3. The electroless plating bath of claim 1, wherein the sulfur-containing compound is a compound bearing one or more sulfur-containing groups selected from the group consisting of —SH (mercapto group), —S— (thioether group), >C=S (thioaldehyde group, thioketone group), —COSH (thiocarboxyl group), —CSSH (dithiocarboxyl group), —$CSNH_2$ (thioamide group) and —SCN (thiocyanate group, isothiocyanate group).

4. The electroless plating bath of claim 1, which contains the sulfur-containing compound in an amount of $10^{-4}$ to 10 g/liter.

5. The electroless plating bath of claim 2, wherein the nitrogenous compound is a compound bearing one or more nitrogen-containing groups selected from the group consisting of —$NH_2$ (primary amino group), >NH (secondary amino group), ≡N (tertiary amino group), ≡N— (quarternary ammonium group), —N=N— (azo group, heterocyclic group), >C=N— (Schiff base residue, heterocyclic group), C=N—OH (oxime group) and >C=NH (imine group, enamine group).

6. The electroless plating bath of claim 5, which contains the nitrogenous compound in an amount of $10^{-4}$ to 50 g/liter.

7. The electroless plating bath of claim 1, which further contains microparticles dispersed therein.

8. The electroless plating bath of claim 7, wherein the microparticles have a particle size in the range of 0.01 to 10 μm.

9. The electroless plating bath of claim 7, which contains the microparticles in an amount of 0.1 to 20 g/liter.

10. A method for forming black coatings by electroless plating, wherein an article to be plated is immersed in the electroless plating bath of claim 1.

11. The method for forming black coatings by electroless plating of claim 10, wherein the article to be plated is a metal article or a non-electroconductive article.

12. A method of forming black coatings containing microparticles by electroless plating, wherein an article to be plated is immersed in the plating bath of claim 7.

13. An electroless plating bath for forming black coatings containing a nickel salt and a reducing agent, which further contains a sulfur-containing compound and zinc ions, and microparticles dispersed therein.

14. The electroless bath of claim 13, which contains a nitrogen-containing compound.

15. The electroless plating bath of claim 13, wherein the sulfur-containing compound is a compound bearing one or more sulfur-containing groups selected from the group consisting of —SH (mercapto group), —S— (thioether group), >C=S (thioaldehyde group, thioketone group), —COSH (thiocarboxyl group), —CSSH (dithiocarboxyl group), —$CSNH_2$ (thioamide group) and —SCN (thiocyante group, isothiocyanate group).

16. The electroless plating bath of claim 13, which contains the sulfur-containing compound in an amount of $10^{-4}$ to 10 g/liter.

17. The electroless plating bath of claim 13, which contains zinc ions in an amount of $10^{-3}$ to 30 g/liter.

18. The electroless plating bath of claim 14, wherein the nitrogenous compound is a compound bearing one or more nitrogen-containing groups selected from the group consisting of —$NH_2$ (primary amino group), >NH (secondary amino group), ≡N (tertiary amino group), ≡N— (quarternary ammonium group), —N=N— (azo group, heterocyclic group), >C=N— (Schiff base residue, heterocyclic group), C=N—OH (oxime group) and >C=NH (imine group, enamine group).

19. The electroless plating bath of claim 18, which contains the nitrogenous compound in an amount of $10^{-4}$ to 50 g/liter.

20. The electroless plating bath of claim 13, wherein the microparticles have a particle size in the range of 0.01 to 10 μm.

21. The electroless plating bath of claim 13, which contains the microparticles in an amount of 0.1 to 20 g/liter.

22. A method for forming black coatings containing microparticles by electroless plating, wherein an article to be plated is immersed in the plating bath of claim 13.

23. The method for forming black coatings by electroless plating of claim 22, wherein the article to be plated is a metal article or a non-electroconductive article.

* * * * *